United States Patent [19]

Krampen et al.

[11] Patent Number: 4,608,102

[45] Date of Patent: Aug. 26, 1986

[54] PRIMER COMPOSITION

[75] Inventors: Adalbert A. Krampen, Lewiston, Id.; Delbert O. Ells, Clarkston, Wash.; Robert K. Bjerke; James P. Ward, both of Lewiston, Id.

[73] Assignee: Omark Industries, Inc., Portland, Oreg.

[21] Appl. No.: 671,442

[22] Filed: Nov. 14, 1984

[51] Int. Cl.[4] ..... C06B 25/34

[52] U.S. Cl. ..... 149/92; 149/37; 149/38; 149/39; 149/40; 149/44; 149/88; 149/99; 149/100; 149/105

[58] Field of Search ..... 149/37, 38, 39, 40, 149/44, 88, 92, 99, 100, 105

[56] References Cited

U.S. PATENT DOCUMENTS

| | | | |
|---|---|---|---|
| 1,318,709 | 10/1919 | Vautin | 149/109.6 |
| 2,123,691 | 7/1938 | Burrows et al. | 149/37 |
| 2,186,426 | 1/1940 | Nash | 149/2 |
| 2,186,427 | 1/1940 | Nash | 149/2 |
| 2,190,777 | 2/1940 | Etchells | 149/62 |
| 2,409,201 | 10/1946 | Finkelstein et al. | 149/37 |
| 2,473,405 | 6/1949 | Zebree | 149/2 |
| 2,987,520 | 6/1961 | Sickman | 260/308 |
| 3,111,524 | 11/1963 | Wiley et al. | 260/308 |
| 3,171,249 | 3/1965 | Bell | 60/35.4 |
| 3,173,921 | 3/1965 | Einberg | 260/299 |
| 3,184,471 | 5/1965 | Harder | 260/308 |
| 3,259,972 | 7/1966 | Long | 149/37 X |
| 3,262,943 | 7/1966 | Kauer | 260/308 |
| 3,263,604 | 8/1966 | Dalton | 101/149.2 |
| 3,310,569 | 3/1967 | Staba | 260/299 |
| 3,321,343 | 5/1967 | Staba | 149/24 |
| 3,348,985 | 10/1967 | Stadler et al. | 149/2 |
| 3,394,142 | 7/1968 | Koshar | 260/308 |
| 3,397,186 | 8/1968 | Torley et al. | 260/78.4 |
| 3,420,137 | 1/1969 | Staba | 86/1 |
| 3,423,259 | 1/1969 | Staba | 149/24 |
| 3,449,179 | 6/1969 | Minekawa et al. | 149/19 |
| 3,463,086 | 8/1969 | Silva et al. | 102/38 |
| 3,483,211 | 12/1969 | Coburn | 260/308 |
| 3,625,855 | 12/1971 | Douda | 252/305 |
| 3,703,208 | 11/1972 | Heckman et al. | 166/247 |
| 3,707,411 | 12/1972 | Gawlick et al. | 149/14 |
| 3,959,041 | 5/1976 | Knapp | 149/2 |
| 3,963,544 | 6/1976 | Staba | 149/23 |
| 4,019,932 | 4/1977 | Schroeder | 149/37 X |
| 4,114,591 | 9/1978 | Nakagawa | 149/37 X |
| 4,130,082 | 12/1978 | Bouchard et al. | 116/5 |
| 4,145,969 | 3/1979 | Gawlick et al. | 102/204 |
| 4,163,682 | 8/1979 | Montgomery et al. | 149/29 |
| 4,363,679 | 12/1982 | Hagel et al. | 149/37 |
| 4,372,210 | 2/1983 | Shaffer et al. | 102/204 |
| 4,464,989 | 8/1984 | Gibson et al. | 149/37 X |

FOREIGN PATENT DOCUMENTS

| | | |
|---|---|---|
| 696145 | 9/1967 | Belgium . |
| 715389 | 11/1968 | Belgium . |
| 817842 | 11/1974 | Belgium . |
| 2466 | 6/1981 | European Pat. Off. . |
| 31045 | 3/1984 | European Pat. Off. . |
| 811335 | 8/1951 | Fed. Rep. of Germany . |
| 1243067 | 11/1965 | Fed. Rep. of Germany . |
| 1646268 | 9/1966 | Fed. Rep. of Germany . |
| 1805358 | 6/1970 | Fed. Rep. of Germany . |
| 2414310 | 3/1974 | Fed. Rep. of Germany . |
| 2543971 | 10/1975 | Fed. Rep. of Germany . |
| 2952069 | 7/1981 | Fed. Rep. of Germany . |
| 2278657 | 2/1976 | France . |
| 2518086 | 6/1983 | France . |
| 48-9937 | 3/1973 | Japan . |
| 50-69211 | 6/1975 | Japan . |
| 27341 | of 1909 | United Kingdom . |
| 13331 | of 1910 | United Kingdom . |
| 1475044 | 6/1977 | United Kingdom . |

OTHER PUBLICATIONS

Ordinance Dept. U.S. Army—Picatinny Arsenal Technical Report No. 407, p. 10 (9/13/33), "Study of New Type of Primer Composition for Fuzes [sic]", (excerpt).

Hawley, The Condensed Chemical Dictionary, 10th ed., Litton Educational Publishing, Inc., 1981, pp. 640–641.

McKown et al., "Effects of Copper and Heavy Metals on the Sensitivity of Pyrotechnic Materials", Compat. Plast. Other Mater. Explos., Propellants, Pyrotech., Symp., 1976, I–B., Chemical Abstract (vol. 87, 1977, p. 93, 87:103955r).

Haksar, C. N., et al., "Oxidation of Dihydrazides with Active Manganese Dioxide", Indian J. Chem. Sect. B, 1979, 18B(5), 478, Chemical Abstract (vol. 92, 1980, p. 662, 92:128541u).

Kaye, S. M., "Encyclopedia of Explosives and Related Items", PATR 2700, vol. 8, U.S. Army Armament Research and Development Command (1978), pp. P184–P198.

Kaye, S. M., "Encyclopedia of Explosives and Related Items", PATR 2700, U.S. Army Armament Research and Development Command, vol. 8 (1978), pp. P184–P198, vol. 10, (1983), pp. Z10–Z11.

Kuprii, V. Z., et al., "Isotopic Study of Thermal Decomposition of Peroxy Compounds of Various Structures", 1973, 90–1, Chemical Abstract (vol. 83, 1975, p. 770, 21239p).

Vol'nov, I. I., "Peroxides, Superoxides, and Ozonides of Alkali and Alkaline Earth Metals", 1966, pp. 78–89.

Sneed, M. C. et al. *Comprehensive Inorganic Chemistry*, vol. 4, p. 57.

Mellor, J. W., "A Comprehensive Treatise on Organic and Theoretical Chemistry", 1940, pp. 530–532.

Onozawa, T., "Fire-Lighting Composition with Fixing of any Chlorine Evolved Using Calcium Peroxide", Chemical Abstract (43:69546t).

FMC Co. Data Sheet, "Calcium and Zinc Peroxide".

*Primary Examiner*—Stephen J. Lechert, Jr.

*Attorney, Agent, or Firm*—Klarquist, Sparkman, Campbell, Leigh & Whinston

[57] ABSTRACT

A primer composition using manganese dioxide as the predominant oxidizer is disclosed. The manganese dioxide oxidizer is combined with a fuel source and nonmetallic initiating explosive material. Various diazo, triazole, or tetrazole compounds may be used as nonmetallic initiating explosives, although diazodinitrophenol is preferred. The combustion by-products of the invention do not include toxic oxides of lead, barium, or mercury. The invention therefore provides distinct safety and environmental advantages.

8 Claims, No Drawings

PRIMER COMPOSITION

BACKGROUND OF THE INVENTION

This invention relates to primer compositions for small arms ammunition and the like.

Small arms primer compositions generally contain three major components including one or more percussion sensitive explosives to act as initiators, a fuel source, and one or more oxidizing compounds. The fuel source acts as a flame producer and combustion modifier. The oxidizing compounds provide oxygen for the fuel source. In addition, other ingredients may be present, including chemical binders and sensitizer materials.

Small arms primer compositions, for the most part, have used a combination of lead styphnate as the initiating explosive, antimony sulfide and aluminum as fuels, and barium nitrate as the oxidizer in various ratios. These priming compositions, when ignited, produce toxic oxides of lead and barium, which in particular situations such as indoor shooting, create potential health and environmental hazards.

SUMMARY OF THE INVENTION

An object of the present invention is to provide a primer composition suitable for use in small arms ammunition systems with minimal environmental hazards.

More specifically, it is an object of the present invention to provide a primer composition for small arms ammunition which does not produce toxic combustion by-products containing lead, barium, or other dangerous materials. A further object of the present invention is to provide a primer composition which may be manufactured under conditions of high moisture without deleterious side chemical reactions.

Other objects and advantages of the present invention will become apparent from the following detailed description and accompanying examples.

DETAILED DESCRIPTION

The primer composition of the present invention comprises a non-metallic percussion sensitive explosive compound combined with a fuel source and manganese dioxide oxidizer. Diazo, triazole, and tetrazole materials, including diazodinitrophenol and tetracene, are suitable non-metallic explosives. However, diazodinitrophenol is preferred since it can be directly synthesized from readily available precurser chemicals. In addition, diazodinitrophenol is a relatively safe material in comparison with compounds containing lead or other heavy metals.

Fuel sources adaptable to the present invention are those commonly known in the art, including aluminum, antimony sulfide, titanium, calcium silicide, nitrocellulose, and zirconium.

Most primer compositions, including that of the present invention, are manufactured under conditions of high moisture to avoid accidental detonation by heat, shock, or impact. Many oxygen donor compounds, such as calcium peroxide, magnesium peroxide, and all water soluble nitrates (including sodium nitrate and potassium nitrate) produce deleterious side chemical reactions when combined with other primer ingredients under high-moisture conditions. Such reactions produce an inferior product with reduced sensitivity to impact. We have found that manganese dioxide, unlike other oxiders, is usable in high-moisture conditions and, as the sole or predominant oxidizer with other ingredients, provides a satisfactory primer that does not create toxic residues when fired. Manganese dioxide is insoluble in water, and does not deleteriously react with other ingredients during high-moisture manufacturing processes. In addition, it is a highly effective oxygen donor. Either synthetic manganese dioxide or natural manganese dioxide (ore) may be used, although synthetic forms are preferred. The higher purity of synthetic manganese dioxide makes it a superior oxygen donor.

In addition to the above components, binding materials may be added. Such binders typically include gum arabic, gum tragacanth, and gelatine. Sensitizing materials may also be added. Powdered glass, titanium, calcium silicide, and tetracene represent commonly known sensitizing materials usable in the present invention.

Secondary explosives may also be added. Such secondary explosives are used to alter the explosive character of the primer, depending on its desired use. These materials include compounds known in the art, excluding those containing lead, barium, mercury, and other harmful elements. Preferred secondary explosives include nitrated esters, such as penthrite and nitromannite.

Primers utilizing manganese dioxide as the sole oxidizer tend to create excessively high pressures. Therefore, it is preferred that a secondary oxidizer be utilized. Strontium peroxide and zinc peroxide are suitable secondary oxidizers. However, zinc peroxide presents fewer residual toxicity problems and is preferred.

The chemical components of the present invention may be combined in various ratios depending on the desired characteristics of the final product. Table 1 generally represents the possible ingredient combinations of the present invention.

TABLE 1

| Chemical Component | Weight Percent |
|---|---|
| Non-metallic primary explosive (e.g. diazodinitrophenol) | 20–40 |
| Sensitizer | 0–10 |
| Fuel | 15–30 |
| Secondary explosive | 0–50 |
| Manganese dioxide | 10–50 |
| Secondary oxidizer | 0–20 |
| Binder | 0–2 |

Illustrative examples of the present invention are provided below:

In preparing the two examples set forth below, the diazodinitrophenol, tetracene, and nitrocellulose were first prepared in a wet state containing 20%, 35%, and 15% water, respectively. These materials were then blended, followed by the addition of atomized aluminum powder (fuel). Next, manganese dioxide and zinc peroxide (containing zinc oxide as an impurity) were combined to form a dry blend. This blend was subsequently combined with the other ingredients described above. A binder comprised of gum arabic, gum tragacanth, gelatine, and water (65%), was then added. In Example II a silica sensitizer was added.

The completed wet priming mixture was pressed into a perforated plate to form pellets of desired size for charging into primer cups. After charging the cups, a foil paper was tamped onto the wet charge, a layer of sealing lacquer placed over the foil, and the primers dried in a dry house at 90° F.

Following drying, the primers were subjected to a conventional "drop test" using a 1.94 oz. average weight dropped onto a rifle firing pin. The "average fire height" set forth below is the drop height at which 50% of the primers fired and 50% failed to fire. An additional lot of primers was placed in 9 mm Luger cartridges and tested for ballistic properties in comparison with cartridges using standard lead styphnate-based primers. The results are as follows:

EXAMPLE 1

| | |
|---|---|
| Diazodinitrophenol | 25.0% |
| Tetracene | 5.0% |
| Nitrocellulose | 22.0% |
| Atomized Aluminum Powder | 5.0% |
| Manganese Dioxide | 24.0% |
| Zinc Peroxide | 10.5% |
| Zinc Oxide | 8.3% |
| Binder | 0.2% |

EXAMPLE 2

| | |
|---|---|
| Diazodinitrophenol | 24.0% |
| Tetracene | 6.0% |
| Nitrocellulose | 22.0% |
| Atomized Aluminum Powder | 5.0% |
| Manganese Dioxide | 16.0% |
| Zinc Peroxide | 14.5% |
| Zinc Oxide | 11.3% |
| Binder | 0.2% |
| Silica | 1.0% |

DROP TEST RESULTS - 50 Samples

| | EXAMPLE 1 | EXAMPLE 2 |
|---|---|---|
| Average fire height | 5.38" | 4.30" |
| Standard deviation | 1.14 | 0.56 |

BALLISTIC PROPERTIES - 10 Samples

| | EXAMPLE 1 | EXAMPLE 2 | Lead Styphnate based primers |
|---|---|---|---|
| Average Chamber Pressure | 31743 | 29807 | 30249 (psi) |
| Standard Deviation | 948 | 682 | 372 |
| Average Muzzle Velocity | 1176 | 1119 | 1155 (fps) |
| Standard Deviation | 14 | 13 | 4 |

As will be apparent to those skilled in the art, the results shown above indicate that the composition of the invention is very satisfactory for its intended purpose.

The invention being thus described, it will be obvious that the same may be varied in many ways. Such variations are not to be regarded as a departure from the spirit and scope of the invention, and all such variations are intended to be included herein.

We claim:

1. A primer composition comprising:

at least one non-metallic percussion sensitive explosive material selected from the class consisting of diazo, triazole, and tetrazole compounds;

at least one fuel source;

manganese dioxide, and a secondary oxidizer selected from the class consisting of strontium peroxide and zinc peroxide, said secondary oxidizer being present in amount not greater by weight than the manganese dioxide.

2. The primer composition of claim 1 wherein said non-metallic explosive is diazodinitrophenol.

3. The primer composition of claim 1 comprising:

a secondary non-metallic explosive.

4. The primer composition of claim 3 wherein said secondary explosive is a nitrated ester.

5. The primer composition of claim 4 wherein said nitrated ester is selected from the group consisting of penthrite and nitromannite.

6. A primer composition comprising about 20–40 percent non-metallic primary explosive material selected from the class consisting of diazo, triazole, and tetrazole compounds, about 0–10 percent sensitizer material, about 15–30 percent fuel material, about 0–50 percent non-metallic secondary explosive, about 10–50 percent manganese dioxide, about 0–20 percent secondary oxidizer selected from the class consisting of zinc peroxide and strontium peroxide, and about 0–2 percent binder material, all of said percentages by weight of said composition, said secondary oxidizer being present in amount not greater than said manganese dioxide.

7. The composition of claim 1 wherein said secondary oxidizer is zinc peroxide.

8. The composition of claim 7 comprising between 16 and 24 percent manganese dioxide and between $10\frac{1}{2}$ and $14\frac{1}{2}$ percent zinc peroxide by weight.

* * * * *